United States Patent [19]

Kale

[11] Patent Number: 4,739,728

[45] Date of Patent: Apr. 26, 1988

[54] THERMAL FOIL FOR WATER HEATERS AND THE LIKE

[76] Inventor: Hemant D. Kale, 5145 N. Kenton, Chicago, Ill. 60630

[21] Appl. No.: 888,563

[22] Filed: Jul. 22, 1986

Related U.S. Application Data

[63] Continuation-in-part of Ser. No. 777,915, Sep. 19, 1985, abandoned.

[51] Int. Cl.[4] ..... F22B 5/00

[52] U.S. Cl. ..... 122/13 R; 122/19; 122/362; 122/488

[58] Field of Search ..... 122/13 R, 235 F, 14–19, 122/488; 126/361, 362, 437; 165/104.19 A

[56] References Cited

U.S. PATENT DOCUMENTS

| | | | |
|---|---|---|---|
| 787,909 | 4/1905 | Fox . | |
| 1,016,959 | 2/1912 | Sadtler . | |
| 1,689,935 | 10/1928 | Shuell | 122/19 |
| 1,817,685 | 8/1931 | Graham | 122/19 |
| 2,207,057 | 7/1940 | Gulick | 257/198 |
| 2,263,031 | 11/1941 | Estes | 122/19 |
| 2,311,469 | 2/1943 | Pruitt | 158/91 |
| 2,440,998 | 5/1948 | Alexander | 122/19 |
| 2,487,705 | 11/1949 | Handley | 122/19 |
| 2,625,138 | 1/1953 | Jacoby | 122/17 |
| 2,814,278 | 11/1957 | Cameron | 122/17 |
| 2,823,649 | 2/1958 | Flynn | 122/17 |
| 2,833,273 | 5/1958 | Miller | 126/362 |
| 2,852,462 | 9/1958 | Andrews | 122/13 R |
| 3,062,233 | 11/1962 | Hammersley | 137/592 |
| 3,244,166 | 4/1966 | Miller | 126/362 |
| 3,500,796 | 3/1970 | Roffler | 122/488 |
| 3,547,306 | 12/1970 | Natterstad | 220/26 |
| 3,987,761 | 10/1976 | Downs et al. | 122/20 |
| 4,390,008 | 6/1983 | Andrews | 126/362 |
| 4,413,747 | 11/1983 | Tenold et al. | 220/225 |
| 4,436,058 | 3/1984 | McAlister | 122/19 |
| 4,494,486 | 1/1985 | Meudler | 122/488 |

*Primary Examiner*—Henry C. Yuen

*Attorney, Agent, or Firm*—John C. Shepard

[57] ABSTRACT

A hot water heater having a vertical, cylindrical tank with a top wall, means for heating water within the tank, a cold water inlet at the bottom and a hot water outlet at the top includes damping vanes associated with the top wall of the tank for foiling internal thermal convection currents at the top of the tank and minimizing the mixing of hot and cold water so that the temperature of the hot water delivered at the outlet remains relatively constant over time.

10 Claims, 1 Drawing Sheet

X - Temperature of Water In Deg. F
Y - Gallons of Water Removed

THERMAL FOIL FOR WATER HEATERS AND THE LIKE

CROSS-REFERENCE TO RELATED APPLICATION

This application is a continuation-in-part of my copending U.S. patent application Ser. No. 777,915 filed Sept. 19, 1985, abandoned.

BACKGROUND OF THE INVENTION

1. Technical Field

This invention relates generally to heating appliances such as hot water heaters and, more particularly, to means for foiling thermal currents within a water heater.

2. Background Art

In the prior art, a storage tank water heater replaces hot water withdrawn from the top of the tank with cold water delivered at the bottom of the tank. Because typical tank heating elements cannot heat the water as fast as it is withdrawn, cold water will eventually fill the tank. Even before the tank is filled with cold water, the incoming cold water mixes freely with the heated standing water in the tank thereby causing deterioration of the tank's water temperature. This mixing is partially the result of the currents generated by the inward flow of cold water, by the outward flow of hot water, and by the convection thermal currents established within the tank.

Because of this mixing, hot water delivered by a typical hot water heater will gradually decrease in temperature while water is being withdrawn, only a small amount of high temperature water is delivered relative to the tank's total capacity. The hot water volume delivered to the outlet above a specified temperature can obviously be extended by increasing the size of the tank or by increasing the heat input of the heating elements. The temperature of hot water at the outlet can also be maintained by preventing the mixing of hot and cold water within the tank.

Attempts have been made in the past to contain and control the mixing of hot and cold water by providing separate chambers within the tank for cold and hot water. Miller U.S. Pat. Nos. 2,833,273 and 3,244,166 employ separate chambers within the tank at the inlet. Gulick U.S. Pat. No. 2,207,057 uses a small baffle over the inlet to control mixing. Fox U.S. Pat. No. 787,909 shows the use of a movable barrier.

McAlister U.S. Pat. No. 4,436,058 attempts to minimize convection tendencies by confining water in numerous capillary type conduits stretched between the tank bottom and the tank top. Shuell U.S. Pat. No. 1,689,935 attempts to obtain constant temperature of water by continuously varying the energy input to the tank by using a feedback control system involving a thermostat.

In substantially different constructions employing the concept of compartmentalization, Jacoby U.S. Pat. No. 2,625,138 divides the tank into a plurality of separate vertical layers by using numerous horizontal baffles and Pruitt U.S. Pat. No. 2,311,469 shows a fuel burner in which several secondary combustion chambers stratify the water in the storage tank.

While these prior art designs tried to reduce flow created by the usual high velocity of incoming cold water and tried to separate hot and cold water layers, none have taken note of the existence of possible convection currents and, thus, none limit the formation of these thermal currents in the tank and concurrently preserve the smooth horizontal boundary layer between hot and cold water within the tank. Further, these convection thermal currents are believed to flow primarily along the smooth side surfaces of the tank and are enhanced by the smooth inner surface of the curved top, the "domed" top being a necessity in pressure tanks because of their structural strength. These closed loop currents greatly enhance the mixing of hot and cold water and heretofore no attempt has been made to stop mixing caused by these currents.

SUMMARY OF THE INVENTION

The present invention is directed to overcoming one or more of the problems as set forth above.

According to the present invention, a conventional hot water heater having a vertical tank with a top wall includes means in the upper portion of the tank for foiling internal thermal convection currents at the top of the tank by damping or disturbing the currents while maintaining the existence of a smooth boundary layer between the hot and cold water within the tank.

In one exemplary embodiment of the invention, circular baffles or collars are attached to the tank top to foil and, thus, inhibit convection currents from becoming established within the tank which aid and enhance the mixing of hot and cold water.

In another exemplary embodiment of the invention, an array of fins are attached to the tank top to foil thermal currents.

A feature of the invention is that the heater will deliver more hot water, in gallons, at a relatively steady temperature.

A further feature of the invention is the minimization of the mixing of hot and cold water within a water heater by the simpliest and least expensive means possible.

Another feature of the invention is that the temperature of hot water delivered at the outlet is held relatively constant without the use of means for stratifying or compartmentalizing the heater tank.

BRIEF DESCRIPTION OF THE DRAWINGS

The details of construction and operation of the invention are more fully described with reference to the accompanying drawings which form a part hereof and in which like reference numerals refer to like numerals throughout.

In the drawings.

DESCRIPTION OF THE PREFERRED EMBODIMENTS

Best Modes for Carrying Out the Invention

Figure 1:
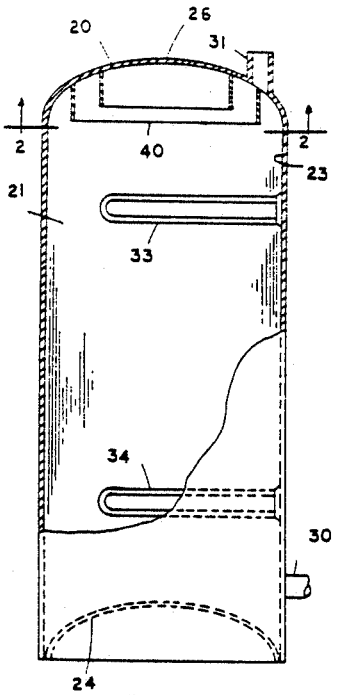
FIG. 1 is a side elevational view, partially in section, of a first embodiment of a hot water heater constructed in accordance with the present invention employing annular vane type baffles attached to the top of the heater tank.

Referring to FIG. 1 of the drawings, a conventional, non-compartmentalized hot water heater, generally designated 20, has a storage tank 21 with an upright, vertical axis. The tank 21 is defined by a cylindrical side wall 23, a bottom wall 24 and a top wall 26.

In a conventional heater such as that shown in FIG. 1, the storage tank 21 has smooth internal walls and, in the upper portion thereof, its interior is open and free of obstructions. The tank 21 has a cold water inlet 30 generally adjacent the bottom thereof and a hot water outlet 31 generally adjacent the top thereof. As shown herein, two electric heating elements 33 and 34 heat the water within the tank, one heating element 33 being located near the bottom of the tank 21 and the other heating element 34 being located closer to the top of the tank 21.

When the heater 20 is in operation, hot water is withdrawn from the top of the tank 21 by way of the outlet 31. Cold water replacing the water withdrawn enters by way of the inlet 30 at the bottom of the tank 21.

Figure 5:
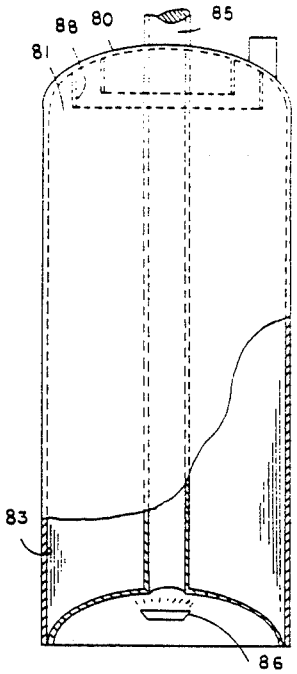
FIG. 5 is a side elevational view, partially in section, of the embodiment on the invention shown in FIG. 1 as used in a gas- or oil-fired water heater.
Figure 2:
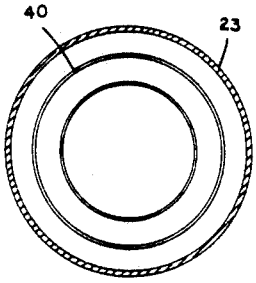
FIG. 2 is a cross-sectional view of the heater taken along line 2—2 of FIG. 1 showing the annular vane baffles.

In a first embodiment of the invention as shown in FIGS. 1 and 2, baffle means, such as annular vanes 40, are attached to the top wall of the tank 21 and extend downward from the tank top wall 26 generally parallel to the vertical tank axis. The vanes 40 extend partially into the tank 21 with the free ends thereof spaced above the bottom wall 24 in the upper portion of the tank 21. The baffle vanes 40, which may be made of metal or other suitable material, obstruct laminar-type flows along the upper surfaces of the tank 21 so that convection thermal currents do not move along the walls of the tank 21. Because of the obstruction of the currents by the vanes 40, the closed loop convection currents that may otherwise be established within the tank 21 are foiled. This minimizes mixing of cold and hot water and the resultant temperature equalization within the tank 21. It should be apparent that a single electric coil or a suitably located gas or oil burner as shown in FIG. 5 could also be used to heat the water within the tank.

The damping baffles 40 define an obstructing surface along the inner surface of the top wall 26 transverse to a smooth curvilinear line outwardly concave and extending across the top of the tank 21 from the upper side wall 23 at one side of the tank 21 to the opposite side. As a result, the flow of thermal currents between the side wall and top wall is not smooth.

As conceived, the damping baffle vanes 40 are formed from thin material and attached to the top wall 26. However, it should be understood that it is possible to form baffles integral with the top wall. It should also be apparent that the vanes need not be circular collars, but may be configured in a variety of other suitable shapes.

Figure 3:
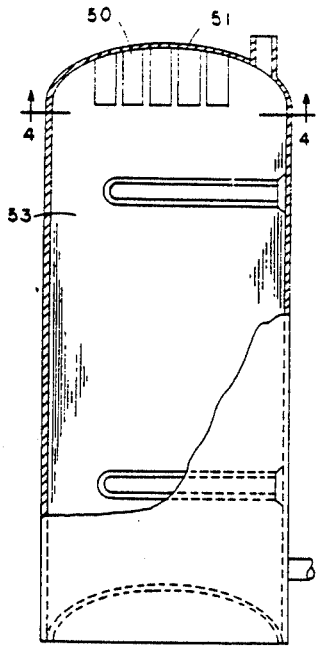
FIG. 3 is a side elevational view, partially in section, of a second embodiment of a hot water heater constructed in accordance with the present invention employing hanging fin type baffles.
Figure 4:
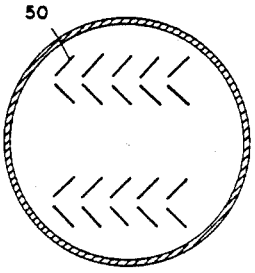
FIG. 4 is a cross-sectional view of the heater taken along line 4—4 of FIG. 3 showing the fin baffles.

In a second embodiment of the invention shown in FIG. 3, a series of flat vane baffles, or fins 50, are attached to the top wall 51 and extend downward into the heater tank 53. As shown in FIG. 4, the fins are arranged in laterally spaced rows with fins in adjacent rows being in transverse or oblique planes.

While two damping constructions are shown herein utilizing foiling baffles to minimize thermal currents in the tank, other arrangements and sizes of baffles mounted in the top of a water heater are possible, since baffles oblique or perpendicular to a concave top wall should foil thermal currents flowing within the tank. Baffles raised sufficiently from the top wall to provide a non-smooth top wall inner surface will positively disturb and, thus, foil any thermal convection currents moving within the tank interior adjacent the top wall.

In FIG. 5, a gas- or oil-fired water heater 80 having a tank 81 with inner surface wall 83, a exhaust flue 85 and a fuel burner 86 is seen to include annular damping baffles 88 similar to those illustrated in FIG. 1. It should be understood that any of the damping constructions illustrated herein may be used in conjunction with gas- or oil-fired heaters.

Comparison tests were conducted using a conventional-type water heater, which was purchased commercially from Sears, Roebuck and Company, and a heater constructed as shown in FIG. 1. This latter heater employed two vanes—one 8 inches in diameter by 2½ inches deep and the other 10 inches in diameter by 2 inches deep. Both heaters employed 14-inch diameter, 30-gallon tanks and were identical in all other respects.

In each of the tests, the heater was flushed for one hour by allowing water to run through the tank without energizing the heating elements. The outlet was then closed, the heating elements energized, and a starting time recorded. The water was heated until the internal thermostat of the heater shut off the heating elements, at which point a second time was recorded. Immediately thereupon, the outlet was opened and outlet water temperature measured at five-second intervals until the outlet temperature dropped to 100 degrees Fahrenheit. The outlet was then closed and total water output was ascertained. The delivery rate in gallons per minute was then calculated from the total water output and the elapsed time. Also, a determination was made of the total kilowatt input to the heater including the kilowatts added to the heater before the withdrawal of water and the kilowatts added during withdrawal of the water.

The tables following the description summarize the results of tests run at various flow rates. For simplicity, a complete test sheet for only one test on the conventional heater and one on the baffled heater is reproduced below. Tables A and B, however, provide the summary data on each heater.

Table A lists the data obtained from the commercially purchased heater;

Table B lists the data obtained from the heater of FIG. 1.

In the tables, degree-gallons were calculated as follows:

$$\text{Degree-Gallons} = Q \times (T_1 - T_0),$$

where Q = quantity of water withdrawn
$T_1$ = temperature of water withdrawn
$T_0$ = temperature of the inlet water

Example

Degree-Gallons = 1.589 × 4 × (149 − 39) = 699.16
where 1.589 = the rate of water withdrawn in -continued gallons per minute 4 = the time in minutes during which outlet water temperature -continued remained at 149 degrees F.

(This example corresponds with the first reading under "Degree-Gallon Output Data" in the commercial heater test data reproduced below.)

MODEL . . . SEARS 30G
GPM . . . 1.589
NO. OF TURNS OPEN . . .
WATER HEIGHTS, In. . . . 12 & 6¼
WATER INLET TEMP. DEG F. . . . 39
TOTAL GALLONS COLLECTED . . . 27.95
TOTAL EXT. SURFACE AREA(SQ. FT) = 15.52

TEST NO . . . 3
DATE . . . TIME . . .
TOTAL ELAPSED TIME
(MIN. S:SEC. S) . . . 17:35
INPUT AMP/VOLTS . . . 15.7/243
TOTAL INPUT KW . . . 7.953

INPUT DATA

| | | | | | | | | | | | | |
|---|---|---|---|---|---|---|---|---|---|---|---|---|
| TIME: | 0:5 | 0:10 | 0:15 | 0:20 | 0:25 | 0:30 | 0:35 | 0:40 | 0:45 | 0:50 | 0:55 | 0:60 |
| TEMP: | 149 | 149 | 149 | 149 | 149 | 149 | 149 | 149 | 149 | 149 | 149 | 149 |
| TIME: | 1:5 | 1:10 | 1:15 | 1:20 | 1:25 | 1:30 | 1:35 | 1:40 | 1:45 | 1:50 | 1:55 | 1:60 |
| TEMP: | 149 | 149 | 149 | 149 | 149 | 149 | 149 | 149 | 149 | 149 | 149 | 149 |
| TIME: | 2:5 | 2:10 | 2:15 | 2:20 | 2:25 | 2:30 | 2:35 | 2:40 | 2:45 | 2:50 | 2:55 | 2:60 |
| TEMP: | 149 | 149 | 149 | 149 | 149 | 149 | 149 | 149 | 149 | 149 | 149 | 149 |
| TIME: | 3:5 | 3:10 | 3:15 | 3:20 | 3:25 | 3:30 | 3:35 | 3:40 | 3:45 | 3:50 | 3:55 | 3:60 |
| TEMP: | 149 | 149 | 149 | 149 | 149 | 149 | 149 | 149 | 149 | 149 | 149 | 149 |
| TIME: | 4:5 | 4:10 | 4:15 | 4:20 | 4:25 | 4:30 | 4:35 | 4:40 | 4:45 | 4:50 | 4:55 | 4:60 |
| TEMP: | 148 | 148 | 148 | 148 | 148 | 148 | 148 | 148 | 148 | 148 | 148 | 148 |
| TIME: | 5:5 | 5:10 | 5:15 | 5:20 | 5:25 | 5:30 | 5:35 | 5:40 | 5:45 | 5:50 | 5:55 | 5:60 |
| TEMP: | 148 | 148 | 148 | 148 | 148 | 147 | 147 | 147 | 147 | 147 | 147 | 147 |
| TIME: | 6:5 | 6:10 | 6:15 | 6:20 | 6:25 | 6:30 | 6:35 | 6:40 | 6:45 | 6:50 | 6:55 | 6:60 |
| TEMP: | 147 | 147 | 147 | 147 | 147 | 147 | 147 | 147 | 146 | 146 | 146 | 146 |
| TIME: | 7:5 | 7:10 | 7:15 | 7:20 | 7:25 | 7:30 | 7:35 | 7:40 | 7:45 | 7:50 | 7:55 | 7:60 |
| TEMP: | 146 | 146 | 146 | 146 | 146 | 145 | 145 | 145 | 145 | 145 | 145 | 145 |
| TIME: | 8:5 | 8:10 | 8:15 | 8:20 | 8:25 | 8:30 | 8:35 | 8:40 | 8:45 | 8:50 | 8:55 | 8:60 |
| TEMP: | 145 | 144 | 144 | 144 | 144 | 144 | 144 | 144 | 144 | 143 | 143 | 143 |
| TIME: | 9:5 | 9:10 | 9:15 | 9:20 | 9:25 | 9:30 | 9:35 | 9:40 | 9:45 | 9:50 | 9:55 | 9:60 |
| TEMP: | 143 | 143 | 143 | 143 | 142 | 142 | 142 | 142 | 142 | 142 | 141 | 141 |
| TIME: | 10:5 | 10:10 | 10:15 | 10:20 | 10:25 | 10:30 | 10:35 | 10:40 | 10:45 | 10:50 | 10:55 | 10:60 |
| TEMP: | 141 | 141 | 141 | 141 | 140 | 140 | 140 | 140 | 140 | 140 | 139 | 139 |
| TIME: | 11:5 | 11:10 | 11:15 | 11:20 | 11:25 | 11:30 | 11:35 | 11:40 | 11:45 | 11:50 | 11:55 | 11:60 |
| TEMP: | 139 | 139 | 139 | 138 | 138 | 138 | 138 | 137 | 137 | 137 | 137 | 137 |
| TIME: | 12:5 | 12:10 | 12:15 | 12:20 | 12:25 | 12:30 | 12:35 | 12:40 | 12:45 | 12:50 | 12:55 | 12:60 |
| TEMP: | 136 | 136 | 136 | 136 | 136 | 135 | 135 | 135 | 134 | 134 | 134 | 134 |
| TIME: | 13:5 | 13:10 | 13:15 | 13:20 | 13:25 | 13:30 | 13:35 | 13:40 | 13:45 | 13:50 | 13:55 | 13:60 |
| TEMP: | 133 | 133 | 133 | 133 | 132 | 132 | 132 | 132 | 131 | 131 | 131 | 131 |
| TIME: | 14:5 | 14:10 | 14:15 | 14:20 | 14:25 | 14:30 | 14:35 | 14:40 | 14:45 | 14:50 | 14:55 | 14:60 |
| TEMP: | 130 | 130 | 130 | 129 | 129 | 128 | 128 | 127 | 127 | 126 | 126 | 125 |
| TIME: | 15:5 | 15:10 | 15:15 | 15:20 | 15:25 | 15:30 | 15:35 | 15:40 | 15:45 | 15:50 | 15:55 | 15:60 |
| TEMP: | 125 | 124 | 124 | 124 | 123 | 123 | 123 | 122 | 121 | 120 | 119 | 119 |
| TIME: | 16:5 | 16:10 | 16:15 | 16:20 | 16:25 | 16:30 | 16:35 | 16:40 | 16:45 | 16:50 | 16:55 | 16:60 |
| TEMP: | 118 | 118 | 117 | 116 | 115 | 115 | 114 | 113 | 112 | 111 | 110 | 109 |
| TIME: | 17:5 | 17:10 | 17:15 | 17:20 | 17:25 | 17:30 | 17:35 | 17:40 | 17:45 | 17:50 | 17:55 | 17:60 |
| TEMP: | 108 | 107 | 106 | 105 | 103 | 102 | 100 | 0 | 0 | 0 | 0 | 0 |

DEGREE-GALLONS OUTPUT DATA:

| I | TIME | T(I) | DG(I) | I | TIME | T(I) | DG(I) | I | TIME | T(I) | DG(I) |
|---|---|---|---|---|---|---|---|---|---|---|---|
| 1 | 4:0 | 149 | 699.16 | 18 | 13:40 | 132 | 49.259 | 35 | 16:30 | 115 | 20.1273 |
| 2 | 5:25 | 148 | 245.368 | 19 | 14:0 | 131 | 48.7293 | 36 | 16:35 | 114 | 9.93125 |
| 3 | 6:40 | 147 | 214.515 | 20 | 14:15 | 130 | 36.1498 | 37 | 16:40 | 113 | 9.79883 |
| 4 | 7:25 | 146 | 127.517 | 21 | 14:25 | 129 | 23.835 | 38 | 16:45 | 112 | 9.66642 |
| 5 | 8:5 | 145 | 112.289 | 22 | 14:35 | 128 | 23.5702 | 39 | 16:50 | 111 | 9.534 |
| 6 | 8:45 | 144 | 111.23 | 23 | 14:45 | 127 | 23.3053 | 40 | 16:55 | 110 | 9.40158 |
| 7 | 9:20 | 143 | 96.3993 | 24 | 14:55 | 126 | 23.0405 | 41 | 17:0 | 109 | 9.26917 |
| 8 | 9:50 | 142 | 81.8335 | 25 | 15:5 | 125 | 22.7757 | 42 | 17:5 | 108 | 9.13675 |
| 9 | 10:20 | 141 | 81.039 | 26 | 15:20 | 124 | 33.7663 | 43 | 17:10 | 107 | 9.00433 |
| 10 | 10:50 | 140 | 80.2445 | 27 | 15:35 | 123 | 33.369 | 44 | 17:15 | 106 | 8.87192 |
| 11 | 11:15 | 139 | 66.2083 | 28 | 15:40 | 122 | 10.9906 | 45 | 17:20 | 105 | 8.7395 |
| 12 | 11:35 | 138 | 52.437 | 29 | 15:45 | 121 | 10.8582 | 46 | 17:25 | 103 | 8.47467 |
| 13 | 12:0 | 137 | 64.8842 | 30 | 15:50 | 120 | 10.7258 | 47 | 17:30 | 102 | 8.34225 |
| 14 | 12:25 | 136 | 64.2221 | 31 | 16:0 | 119 | 21.1867 | 48 | 17:35 | 100 | 8.07742 |
| 15 | 12:40 | 135 | 38.136 | 32 | 16:10 | 118 | 20.9218 | 49 | 999:0 | 0 | 0 |
| 16 | 13:0 | 134 | 50.3183 | 33 | 16:15 | 117 | 10.3285 | 50 | 0:0 | 0 | 0 |

-continued

DEGREE-GALLONS OUTPUT DATA:

| I | TIME | T(I) | DG(I) | I | TIME | T(I) | DG(I) | I | TIME | T(I) | DG(I) |
|---|---|---|---|---|---|---|---|---|---|---|---|
| 17 | 13:20 | 133 | 49.7887 | 34 | 16:20 | 116 | 10.1961 | 51 | 0:0 | 0 | 0 |

MODEL . . . SEARS 30G GPM . . . 1.589
TOTAL TIME IN SEC. S = 1055
TOTAL OUTPUT IN DEGREE/GALLONS (100 DEG DATUM) = 2786.97
TOTAL OUTPUT IN DEGREE-GALLONS/KW = 350.431
TOTAL OUTPUT IN DEGREE-GALLONS/KW/SQ. FT = 22.5793
PERCENTAGE OF CAPACITY DELIVERED = .931667

MODEL . . . T'VANE 1A
GPM . . . 1.45
NO. OF TURNS OPEN . . .
WATER HEIGHTS, In. . . .
WATER INLET TEMP. DEG F. . . . 57
TOTAL GALLONS COLLECTED . . . 32.62
TOTAL EXT. SURFACE AREA(SQ. FT) = 15

TEST NO . . . 2
DATA . . . TIME . . .
TOTAL ELAPSED TIME
(MIN. S:SEC. S) . . . 22:30
INPUT AMP/VOLTS . . . 15.5/245
TOTAL INPUT KW . . . 7.351

INPUT DATA

| | | | | | | | | | | | | |
|---|---|---|---|---|---|---|---|---|---|---|---|---|
| TIME: | 0:5 | 0:10 | 0:15 | 0:20 | 0:25 | 0:30 | 0:35 | 0:40 | 0:45 | 0:50 | 0:55 | 0:60 |
| TEMP: | 146 | 146 | 146 | 146 | 146 | 146 | 146 | 146 | 146 | 146 | 146 | 146 |
| TIME: | 1:5 | 1:10 | 1:15 | 1:20 | 1:25 | 1:30 | 1:35 | 1:40 | 1:45 | 1:50 | 1:55 | 1:60 |
| TEMP: | 146 | 146 | 146 | 146 | 146 | 146 | 146 | 146 | 146 | 146 | 146 | 146 |
| TIME: | 2:5 | 2:10 | 2:15 | 2:20 | 2:25 | 2:30 | 2:35 | 2:40 | 2:45 | 2:50 | 2:55 | 2:60 |
| TEMP: | 146 | 146 | 146 | 146 | 146 | 146 | 146 | 146 | 146 | 146 | 146 | 146 |
| TIME: | 3:5 | 3:10 | 3:15 | 3:20 | 3:25 | 3:30 | 3:35 | 3:40 | 3:45 | 3:50 | 3:55 | 3:60 |
| TEMP: | 146 | 146 | 146 | 146 | 146 | 146 | 146 | 146 | 146 | 146 | 146 | 146 |
| TIME: | 4:5 | 4:10 | 4:15 | 4:20 | 4:25 | 4:30 | 4:35 | 4:40 | 4:45 | 4:50 | 4:55 | 4:60 |
| TEMP: | 146 | 146 | 146 | 146 | 146 | 146 | 146 | 146 | 146 | 146 | 146 | 146 |
| TIME: | 5:5 | 5:10 | 5:15 | 5:20 | 5:25 | 5:30 | 5:35 | 5:40 | 5:45 | 5:50 | 5:55 | 5:60 |
| TEMP: | 146 | 146 | 146 | 146 | 146 | 146 | 146 | 146 | 146 | 146 | 146 | 146 |
| TIME: | 6:5 | 6:10 | 6:15 | 6:20 | 6:25 | 6:30 | 6:35 | 6:40 | 6:45 | 6:50 | 6:55 | 6:60 |
| TEMP: | 146 | 146 | 146 | 146 | 146 | 146 | 146 | 146 | 146 | 146 | 146 | 146 |
| TIME: | 7:5 | 7:10 | 7:15 | 7:20 | 7:25 | 7:30 | 7:35 | 7:40 | 7:45 | 7:50 | 7:55 | 7:60 |
| TEMP: | 146 | 146 | 146 | 146 | 146 | 146 | 146 | 146 | 146 | 146 | 146 | 146 |
| TIME: | 8:5 | 8:10 | 8:15 | 8:20 | 8:25 | 8:30 | 8:35 | 8:40 | 8:45 | 8:50 | 8:55 | 8:60 |
| TEMP: | 146 | 146 | 146 | 146 | 146 | 146 | 146 | 146 | 146 | 146 | 146 | 146 |
| TIME: | 9:5 | 9:10 | 9:15 | 9:20 | 9:25 | 9:30 | 9:35 | 9:40 | 9:45 | 9:50 | 9:55 | 9:60 |
| TEMP: | 146 | 146 | 146 | 146 | 146 | 146 | 146 | 146 | 146 | 146 | 146 | 146 |
| TIME: | 10:5 | 10:10 | 10:15 | 10:20 | 10:25 | 10:30 | 10:35 | 10:40 | 10:45 | 10:50 | 10:55 | 10:60 |
| TEMP: | 146 | 146 | 146 | 146 | 146 | 146 | 146 | 146 | 146 | 146 | 146 | 146 |
| TIME: | 11:5 | 11:10 | 11:15 | 11:20 | 11:25 | 11:30 | 11:35 | 11:40 | 11:45 | 11:50 | 11:55 | 11:60 |
| TEMP: | 146 | 146 | 146 | 145 | 145 | 145 | 145 | 145 | 145 | 145 | 145 | 145 |
| TIME: | 12:5 | 12:10 | 12:15 | 12:20 | 12:25 | 12:30 | 12:35 | 12:40 | 12:45 | 12:50 | 12:55 | 12:60 |
| TEMP: | 145 | 145 | 145 | 145 | 145 | 145 | 145 | 145 | 145 | 145 | 145 | 145 |
| TIME: | 13:5 | 13:10 | 13:15 | 13:20 | 13:25 | 13:30 | 13:35 | 13:40 | 13:45 | 13:50 | 13:55 | 13:60 |
| TEMP: | 145 | 145 | 145 | 144 | 144 | 144 | 143 | 143 | 141 | 140 | 139 | 138 |
| TIME: | 14:5 | 14:10 | 14:15 | 14:20 | 14:25 | 14:30 | 14:35 | 14:40 | 14:45 | 14:50 | 14:55 | 14:60 |
| TEMP: | 137 | 136 | 134 | 132 | 130 | 128 | 127 | 124 | 122 | 119 | 118 | 117 |
| TIME: | 15:5 | 15:10 | 15:15 | 15:20 | 15:25 | 15:30 | 15:35 | 15:40 | 15:45 | 15:50 | 15:55 | 15:60 |
| TEMP: | 115 | 113 | 112 | 111 | 111 | 110 | 110 | 109 | 109 | 109 | 108 | 108 |
| TIME: | 16:5 | 16:10 | 16:15 | 16:20 | 16:25 | 16:30 | 16:35 | 16:40 | 16:45 | 16:50 | 16:55 | 16:60 |
| TEMP: | 108 | 108 | 108 | 107 | 107 | 107 | 107 | 107 | 107 | 107 | 107 | 106 |
| TIME: | 17:5 | 17:10 | 17:15 | 17:20 | 17:25 | 17:30 | 17:35 | 17:40 | 17:45 | 17:50 | 17:55 | 17:60 |
| TEMP: | 106 | 106 | 106 | 106 | 106 | 106 | 106 | 106 | 106 | 106 | 106 | 106 |
| TIME: | 18:5 | 18:10 | 18:15 | 18:20 | 18:25 | 18:30 | 18:35 | 18:40 | 18:45 | 18:50 | 18:55 | 18:60 |
| TEMP: | 106 | 106 | 106 | 106 | 106 | 106 | 105 | 105 | 105 | 105 | 105 | 105 |
| TIME: | 19:5 | 19:10 | 19:15 | 19:20 | 19:25 | 19:30 | 19:35 | 19:40 | 19:45 | 19:50 | 19:55 | 19:60 |
| TEMP: | 105 | 105 | 105 | 105 | 105 | 105 | 105 | 105 | 105 | 105 | 105 | 105 |
| TIME: | 20:5 | 20:10 | 20:15 | 20:20 | 20:25 | 20:30 | 20:35 | 20:40 | 20:45 | 20:50 | 20:55 | 20:60 |
| TEMP: | 105 | 105 | 105 | 104 | 104 | 104 | 104 | 104 | 104 | 104 | 104 | 104 |
| TIME: | 21:5 | 21:10 | 21:15 | 21:20 | 21:25 | 21:30 | 21:35 | 21:40 | 21:45 | 21:50 | 21:55 | 21:60 |
| TEMP: | 104 | 104 | 104 | 103 | 103 | 102 | 102 | 102 | 102 | 101 | 101 | 101 |
| TIME: | 22:5 | 22:10 | 22:15 | 22:20 | 22:25 | 22:30 | 22:35 | 22:40 | 22:45 | 22:50 | 22:55 | 22:60 |
| TEMP: | 101 | 101 | 100 | 100 | 100 | 100 | 999 | 999 | 999 | 999 | 999 | 999 |

DEGREE-GALLONS OUTPUT DATA:

| I | TIME | T(I) | DG(I) | I | TIME | T(I) | DG(I) | I | TIME | T(I) | DG(I) |
|---|---|---|---|---|---|---|---|---|---|---|---|
| 1 | 11:15 | 146 | 1451.81 | 13 | 14:25 | 130 | 8.82083 | 25 | 15:35 | 110 | 12.8083 |
| 2 | 13:15 | 145 | 255.2 | 14 | 14:30 | 128 | 8.57917 | 26 | 15:50 | 109 | 18.85 |
| 3 | 13:30 | 144 | 31.5375 | 15 | 14:35 | 127 | 8.45833 | 27 | 16:15 | 108 | 30.8125 |
| 4 | 13:40 | 143 | 20.7833 | 16 | 14:40 | 124 | 8.09583 | 28 | 16:55 | 107 | 48.3333 |
| 5 | 13:45 | 141 | 10.15 | 17 | 14:45 | 122 | 7.85417 | 29 | 18:30 | 106 | 112.496 |
| 6 | 13:50 | 140 | 10.0292 | 18 | 14.50 | 119 | 7.49167 | 30 | 20:15 | 105 | 121.8 |
| 7 | 13:55 | 139 | 9.90833 | 19 | 14:55 | 118 | 7.37083 | 31 | 21:15 | 104 | 68.15 |
| 8 | 14:0 | 138 | 9.7875 | 20 | 15:0 | 117 | 7.25 | 32 | 21:25 | 103 | 11.1167 |

-continued

| DEGREE-GALLONS OUTPUT DATA: | | | | | | | | | | | |
|---|---|---|---|---|---|---|---|---|---|---|---|
| I | TIME | T(I) | DG(I) | I | TIME | T(I) | DG(I) | I | TIME | T(I) | DG(I) |
| 9 | 14:5 | 137 | 9.66667 | 21 | 15:5 | 115 | 7.00833 | 33 | 21:45 | 102 | 21.75 |
| 10 | 14:10 | 136 | 9.54583 | 22 | 15:10 | 113 | 6.76667 | 34 | 22:10 | 101 | 26.5833 |
| 11 | 14:15 | 134 | 9.30417 | 23 | 15:15 | 112 | 6.64583 | 35 | 22:30 | 100 | 20.7833 |
| 12 | 14:20 | 132 | 9.0625 | 24 | 15:25 | 111 | 13.05 | 36 | 999:999 | 999 | 0 |

MODEL . . . T'VANE 1A GPM . . . 1.45
TOTAL TIME IN SEC. S = 1350
TOTAL OUTPUT IN DEGREE/GALLONS (100 DEG DATUM) = 2427.66
TOTAL OUTPUT IN DEGREE-GALLONS/KW = 330.249
TOTAL OUTPUT IN DEGREE-GALLONS/KW/SQ. FT = 22.0166
PERCENTAGE OF CAPACITY DELIVERED = 1.08733

TABLE A

| MODEL: SEARS, RATED 3.8 KW, 240 V, 1 PH | | | | |
|---|---|---|---|---|
| TEST NO. | S1 | S2 | S3 | S4 |
| INLET WATER TEMP. Deg. F. | 35 | 38 | 39 | 38 |
| GPM(1) | 1.142 | 1.20 | 1.589 | 1.985 |
| TOTAL KW(2) | 8.238 | 7.862 | 7.953 | 7.789 |
| DG-GLN(3) | 2739 | 2637 | 2787 | 2816 |
| DG-GLN/KW(4) | 333 | 335 | 350 | 362 |
| DG-GLN/KW/SQ. FT(5) | 21.43 | 21.62 | 22.57 | 23.29 |
| GALLONS COLLECTED(6) | 26.96 | 26.76 | 27.95 | 27.95 |
| GALLONS IN 1ST 10 DEG. F. TEMP DROP(7) | 21.21 | 19.39 | 17.87 | 17.00 |

TABLE B

| MODEL: HEATER OF FIG. 1, RATED 3.8 KW, 240 V, 1 PH | | | | |
|---|---|---|---|---|
| TEST NO. | V1 | V2 | V3 | V4 |
| INLET WATER TEMP. Deg. F. | 57 | 56 | 57 | 57 |
| GPM(1) | 1.00 | 1.25 | 1.45 | 1.97 |
| TOTAL KW(2) | 8.386 | 7.299 | 7.351 | 6.698 |
| DG-GLN(3) | 2860 | 2325 | 2427 | 2055 |
| DG-GLN/KW(4) | 341 | 318 | 330 | 306 |
| DG-GLN/KW/SQ. FT(5) | 22.74 | 21.23 | 22.01 | 20.45 |
| GALLONS COLLECTED(6) | 39 | 33.65 | 32.62 | 27.73 |
| GALLONS IN 1ST 10 Dg. F. TEMP. DROP(7) | 22.33 | 20.72 | 20.53 | 17.88 |

Figure 6:
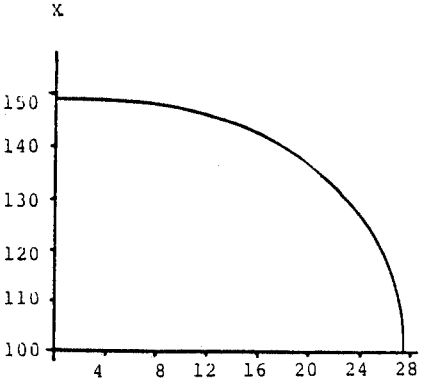
FIG. 6 is a X-Y graph plotting gallons of water delivered versus temperature of water delivered at the outlet in a conventional hot water heater; and, FIG. 7 is a X-Y graph plotting gallons of water delivered versus temperature of water delivered at the outlet in a hot water heater constructed as shown in FIG. 1.
Figure 7:
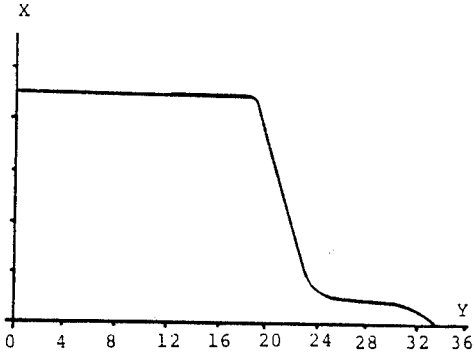

(1)GPM—Gallons per minute
(2)Total KW—Total KW input to the heater
(3)DG-GLN—Degree-gallons of water collected, 100 Deg. F. datum
(4)DG-GLN/KW—Degree-gallons per KW of input
(5)DG-GLN/KW/SQ. FT—Degree-Gallons per KW per Sq. Ft. of external surface of tank
(6)GALLONS COLLECTED—Total gallons collected, 100 Deg. drop
(7)GALLONS IN 1ST 10 DEG. F. TEMP DROP—Gallons of hot water (100 Deg. F. datum) collected in the 1st 10 Deg. F. temp. drop FIG. 6 graphically illustrates the results listed in Table A, and FIG. 7 graphically illustrates the dramatic and unexpected results listed in Table B. The downward curve of FIG. 6 indicates that in a conventional heater, outlet water temperature declines markedly as water is taken from the tank. In contrast, the flat curve of FIG. 7 shows that when the tank has thermal foil vanes, outlet water temperature remains relatively constant as water is withdrawn until the tank capacity is nearly exhausted. While the total amount of heat in the tank's water is the same in both instances, the tank with damping vanes provides hotter water for a longer period of time.

Industrial Applicability

From the foregoing, it should be apparent that the hot water heater described herein is simple and inexpensive, yet provides a convenient and reliable means for delivering more hot water from the tank outlet at a relatively constant temperature for a sustained period of time.

Other aspects, objects and advantages of this invention can be obtained from a study of the drawings, the disclosure and the appended claims.

What is claimed is:

1. In a liquid heater having a vertical storage tank defined by a cylindrical side wall, a bottom wall and a curved top wall outwardly concave and having a non-compartmentalized internal storage area, means for heating water within the tank, a cold water inlet generally adjacent the bottom thereof, and a hot water outlet generally adjacent the top thereof, the improvement comprising at least one damping vane having a thin cross section relative to storage tank diameter and being disposed within the upper portion of the storage area extending from the top wall generally downward into the tank with a free end spaced above the bottom wall at a point in the upper half of the tank, whereby said damping vane foils thermal currents flowing along the top wall of the tank to inhibit smooth flow along the top wall.

2. The heater of claim 1 wherein said vane extends vertically from the top wall into the tank parallel to the tank axis.

3. The heater of claim 1 wherein each vane is a fin having a generally flat configuration.

4. The heater of claim 1 wherein two annular vanes extend from the top wall downwardly into the tank.

5. The heater of claim 1 wherein a series of vanes extend from the top wall downwardly into the tank.

6. The heater of claim 5 wherein said vanes are fins having a generally flat configuration.

7. The heater of claim 6 wherein said fins are arranged in a series of spaced rows extending laterally across the top of the tank.

8. The heater of claim 7 wherein said fins in adjacent rows lie in oblique planes.

9. The heater of claim 1 wherein said damping vane is integral with the inner surface of the top wall, at least a portion of said damping vane extending generally downward from the top wall into the interior of the tank.

10. In a liquid heater having a vertical storage tank defined by a cylindrical side wall, a bottom wall and a curved top wall and having a non-compartmentalized internal storage area, means for heating water within the tank, a cold water inlet generally adjacent the bottom thereof, and a hot water outlet generally adjacent the top thereof, the improvement comprising damping means associated with the heater top wall for foiling thermal currents flowing along the top wall of the tank, said damping means including at least one thin vane extending generally downward from the top wall into the upper portion of the tank transverse to a smooth curvilinear line outwardly concave and extending across the tank from the upper side wall at one side to the opposite side, said vane having a free end spaced above the bottom wall in the upper half of the tank, whereby the smooth flow of thermal currents along the top wall of the tank are inhibited.

* * * * *